US006231441B1

(12) United States Patent
Golad

(10) Patent No.: US 6,231,441 B1
(45) Date of Patent: May 15, 2001

(54) COMPUTER GAME DEVICE

(76) Inventor: Adar Golad, Scherenenkweg 16, 8051 KH Hattem (NL)

( * ) Notice: Subject to any disclaimer, the term of this patent is extended or adjusted under 35 U.S.C. 154(b) by 0 days.

(21) Appl. No.: 09/284,366

(22) PCT Filed: Oct. 27, 1997

(86) PCT No.: PCT/NL97/00589

§ 371 Date: Apr. 14, 1999

§ 102(e) Date: Apr. 14, 1999

(87) PCT Pub. No.: WO98/19758

PCT Pub. Date: May 14, 1998

(30) Foreign Application Priority Data

Nov. 1, 1996 (NL) ..... 1004407

(51) Int. Cl.[7] ..... A63F 3/02
(52) U.S. Cl. ..... 463/9; 273/237
(58) Field of Search ..... 463/9; 273/236, 273/237, 271, 284

(56) References Cited

U.S. PATENT DOCUMENTS

| | | | | |
|---|---|---|---|---|
| 3,697,076 | * | 10/1972 | Vogel | 273/131 A |
| 3,888,491 | * | 6/1975 | Bernard et al. | 273/136 A |
| 4,082,285 | * | 4/1978 | Bathurst | 273/237 |
| 5,423,556 | * | 6/1995 | Latypov | 273/434 |
| 5,558,335 | * | 9/1996 | Wise | 273/237 |
| 5,678,001 | * | 10/1997 | Nagel et al. | 395/173 |

FOREIGN PATENT DOCUMENTS

| | | | |
|---|---|---|---|
| 0109778 | | 5/1984 | (EP) . |
| 2625344 | | 6/1989 | (FR) . |
| 2097265 | | 11/1982 | (GB) . |
| 2147817A | * | 5/1985 | (GB) ..... 3/2 |
| 2229098A | * | 9/1990 | (GB) ..... 3/2 |
| 9119551 | | 12/1991 | (WO) . |

* cited by examiner

*Primary Examiner*—Jessica J. Harrison
*Assistant Examiner*—Scott E. Jones
(74) *Attorney, Agent, or Firm*—Ladas & Parry

(57) ABSTRACT

A computer game device provided with a games' board and a computer connected thereto for controlling game facets. The games' board has a first number of side edges and a second number of playing areas. Each playing area contains an activation element connected with the computer, in which operating the activation element activates or deactivates certain game facets, and has a mark device for separately displaying an equal number of distinctive marks as side edges. Each mark device being connected to the corresponding activation element and to the computer and is operable by the activation element and/or the computer. Each side edge containing a third number of operating means for operating the computer for activating or deactivating certain game facets.

9 Claims, 1 Drawing Sheet

COMPUTER GAME DEVICE

SUMMARY OF THE INVENTION

The present invention relates to a computer game provided with a games' board and a computer connected thereto for controlling game facets.

Nowadays there are numerous computer games or computer assisted games having a great variety of subjects and games to be played on a games' board. It is an object of the present invention to provide an alternative computer game with which in a simple manner the game can be played by one or more persons.

For this purpose the invention provides a computer game provided with a games' board and a computer connected thereto for controlling game facets, said games' board having a first number of side edges and a second number of playing areas, each playing area containing an activation element connected with the computer, in which operating the activation element activates or deactivates a certain game facet, and having a mark device for separately displaying a number of distinctive marks, said number of distinctive mark corresponding to said first number of side edges, each mark device being connected to the corresponding activation element and to the computer and being operable by the activation element and/or the computer, each side edge containing a third number of operating means for operating the computer for activating or deactivating certain game facets. As each playing area can display a number of distinctive marks, a game assisted by the computer or a computer chip can be played on the games' board by a same number of players as the number of distinctive marks. The game to be played depends on the programme loaded in the computer or the chip in which certain game facets can be activated or deactivated by operating the activation elements and/or the operating Means.

In U.S. Pat. No. 3,888,491 an electronic system is disclosed for the remote transmission and display of game moves in real time in which one or more electronic board game consoles are provided, each having a 64-square chess board. Positioned beneath each of the 64 squares on each console, there is located a display unit which on proper energization is capable of producing a display image of any one of the game playing pieces. Logic circuitry is provided to permit each player of the game to selectively cause his images to be automatically transferred from one square to another as well as to selectively create or eliminate those piece images at preselected squares. Logic circuitry is further provided in which a plurality of board square memory elements, at least one for each square of the board, store coded representations of the playing piece images, and wherein said representations are monitored by decoding devices which facilitate the display of a given piece image at a given square. Additional logic circuitry is provided comprising at least one temporary storage memory element serving as a temporary storage for the coded representation of a playing piece transferred from one square to another, while an enabling circuit is provided to permit the transfer of an image only to those destination squares either at which no image is currently displayed, or at which an image belonging to an opposing player is displayed.

Thus U.S. Pat. No. 3,888,491 relates contrary to the present invention to the game of chess, necessitating that any one of the chess game pieces (six black ones, six white ones) can be displayed on each playing area. This is, amongst other things, contrary to the invention in which the number of distinctive marks to be displayed on each playing area corresponds to the number of side edges of the games' board.

The games' board can be displayed on a touch-sensitive screen, each activation element being a part of the screen, i.e. a displayed playing area.

Alternatively, the games' board is a physical games' board, each activation element being a push-button.

BRIEF DESCRIPTION OF THE FIGURE

Various embodiments of a computer game according to the present invention will be described by way of example on the basis of the figure, the figure schematically representing a top view of a physical games' board with push-buttons and a computer integrated therein.

DETAILED DESCRIPTION OF THE PREFERRED EMBODIMENT

Figure 1:
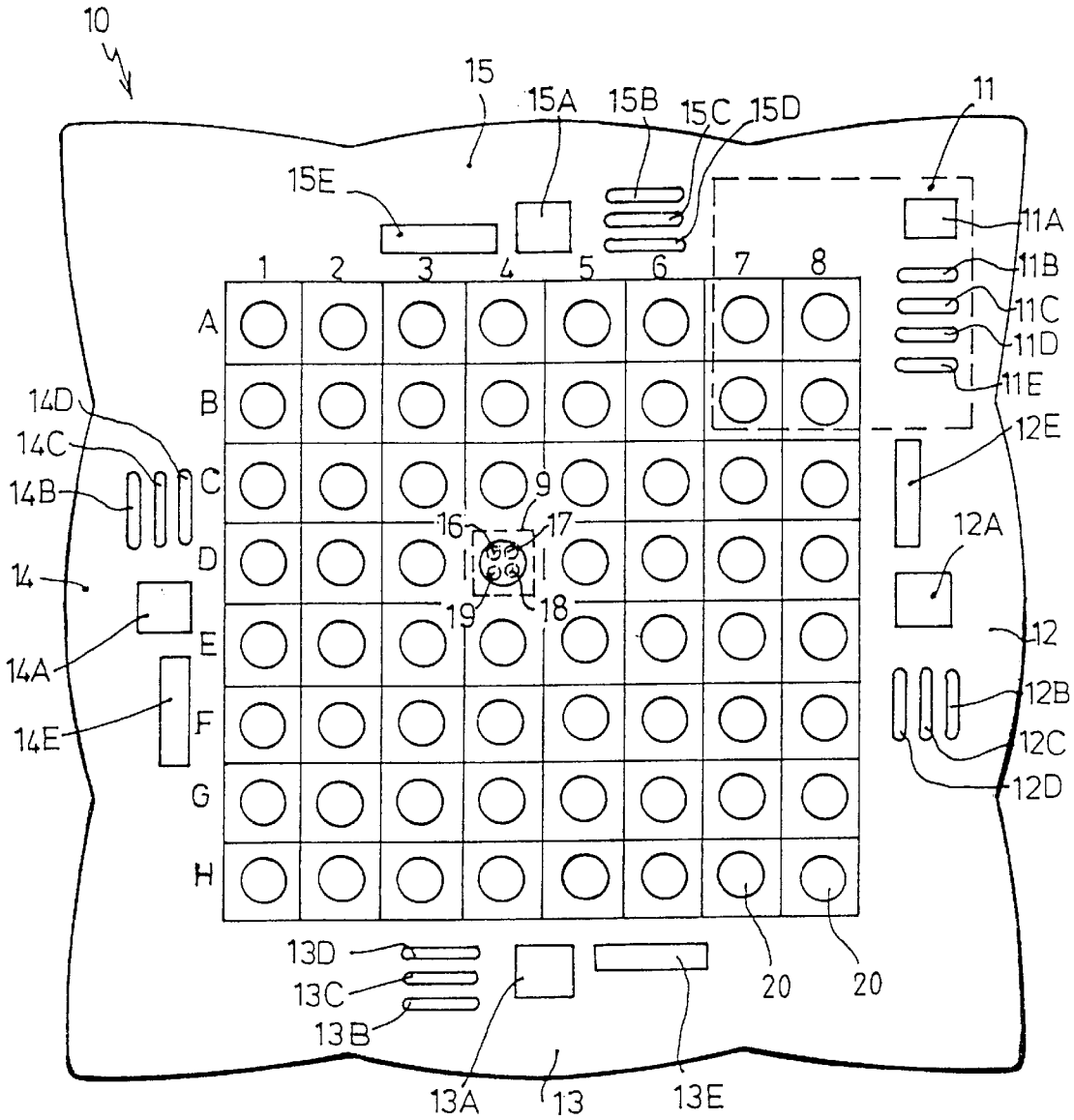

The present invention will be described on the basis of a games' board with four side edges and four distinctive marks per playing area, so that four players can play a game, it being so that the computer can replace one or more players, but it will be clear that the games' board can have three, five or more side edges, and that each playing area can therefore display three, five or more distinctive marks. In addition, the computer game according to the invention will be elucidated on the basis of a "Go"-like game to be played by four players, it being clear, however, that depending on the computer program, i.e. the software, the computer game is suitable for playing one or more other games.

The computer game shown in the figure is provided with a games' board 10 and a computer 11 integrated therein for controlling certain game facets. Although the computer is shown as being integrated in the games' board, it can also be a separate unit which is connected to the games' board via a line.

The games' board 10 has a first number of side edges 12, 13, 14 and 15, in this embodiment four, and a second number of playing areas A1 to H8, in this embodiment 64, which are disposed in a square. The number of playing areas as well as the configuration formed by them is variable. Along with a square configuration, a round, a triangular or cross-shaped one is possible, too, depending on the game to be played.

Each playing area contains a push-button 20 which is connected to the computer 11. Furthermore, each playing area has a mark device 9 for separately displaying an equal number of distinctive marks as there are side edges, i.e. four distinctive marks 16, 17, 18, 19 in the exemplary embodiment shown. Each mark device 9 is connected to the corresponding push-button and to the computer 11, in which, depending on the operation of the push-button and/or the computer 11, the mark device displays one of the distinctive marks.

In the exemplary embodiment shown each push-button is round and disposed in a square playing area. However, the present invention is not restricted to this and the push-button as well as the playing area can, for instance, have any given shape, and the playing area can also be formed by the push-button itself, for example.

Letters, numerals, symbols, projecting flags or other figures can be used as distinctive mark, but a colour that can be clearly seen from all side edges of the games' board, regardless of the direction of perception is preferably used.

A further improvement of the perceptibility of the distinctive mark is obtained in that the mark device contains a fluorescent element, for instance a lamp or a LED for displaying the colour in a light emitting manner. For displaying four colours, for example, a mark device with one lamp and four colour filters or LED's, or with a four-tone LED, or with two two-tone LED's, or with one three-tone and one single-tone LED can be used.

A compact and user-friendly computer game can be obtained by manufacturing each push-button of transparent material and placing the corresponding fluorescent element under the push-button.

Each side edge 12, 13, 14 and 15 of the games' board 10 contains a third number of operating means per side edge, four in the exemplary embodiment, referred to as A, 3, C and D, for operating the computer in order to activate or deactivate certain game facets. The operating means, such as push-buttons, touch controls or switches, for instance, can have a start, a reset, a help, a correction and an o.k. or an acknowledge function. Likewise the side edges can have operating means for selecting certain computer functions, such as selecting the game type, the standard of the game, giving help service and the like. Preferably suchlike operating means 11A to 11E are arranged on a central operating position on the games' board 10, as shown in the figure.

So as to provide each player with game information, such as the current score, the indication who's turn it is, a suggestion for a move and so on, every side edge 12, 13, 14 and 15 is provided with a display screen 12E, 13E, 14E and 15E, for instance a LCD screen for displaying game information.

Preferably at least one of the operation devices 12A, 13A, 14A and 15A of each side edge is provided with a mark belonging to one distinctive mark of a playing area, to specify which side edge, i.e. which players belong to which mark. Preferably this one operating means is a transparent push-button under which there is a fluorescent element, for example an LED, with the colour in question.

After this an exemplary operation of the computer game according to the present invention will be elucidated on the basis of a "Go"-like game to be played by four players. The four side edges 12, 13, 14 and 15 correspond to the four players, respectively. In this example the fluorescent colours red, blue, yellow and green, respectively, are used as distinctive marks. Each playing area then contains a mark device 9, with, in this case, four LED's 17, 18, 19 and 16 for emitting red, blue, yellow and green lights, respectively.

When switching on the games' board 10, by operating push-button 11A, for instance, the computer 10 activates all mark devices 9 of all playing areas Al to H8 to allow each colour to emit light for a short period in order to check whether there are any defective LED's. By pressing button 11B the game type can be selected, which game type appears on the LCD screens 12E to 15E. By operating the operating means 11C to 11E only human players can be selected, although the computer can play for a player, the game level or playing strength of the computer then being selected too.

Upon starting the game the computer 11 causes the LED's in the push-buttons 12A to 15A to flash and selects at random which player may commence. This player's LED, say the "red" player 12, keeps on flashing, whereas those of the other players go out. In the meantime the computer 11 has set up the initial playing situation on the games' board 10. As a result of the respective LED lighting up, the playing area D4 is red, D5 green, E4 blue and E5 yellow in this initial situation. It is the turn of the "red" player 12 and he presses a push-button to trap one of the other players. The red player 12 presses the push-button playing area D3. The computer 11 recognizes this as an incorrect move and indicates this by means of a sound and/or message on the LCD screen 12E. Subsequently the red player 12 works the operating means with the help function and the computer causes the playing areas D6, F6 and F4 to flash in red in order to show which moves can be made. The red player 12 presses the press-button of playing area F4, the LED of which goes on flashing, while the red LED's of the other playing areas are turned off. The red player 12 acknowledges his move by pushing his press-button 12A, after which the red LED of playing area F4 then goes on continuously, and the blue LED of E4 is turned off, while the red LED of E4 is turned on continuously. By his move the red player has thus "trapped" the blue player. The switch from the red player's 12 turn to that of the blue player 13 is indicated by the red LED under press-button 12A going out, and the blue LED under press-button 13A flashing. As the blue player 13 cannot make a move with which to trap another player, the computer 11 permits him to occupy a playing area which borders one of the playing areas already held. The blue player 13 can thus occupy playing area C3, C4, C5, C6, D6, E6, F6, F5, G5, G4, G3, F3, E3 or D3 by pressing the corresponding press-button and then acknowledging his move by pressing press-button 13A. The players can thus in turn occupy a playing area until at the end of the game all the playing areas are taken. The computer 11 then calculates which player holds the most playing areas and indicates that he is the winner by causing the LED (12A to 15A) in question to flash and/or by displaying a message on the LCD screen, accompanied if so desired by a suitable tune.

During the game it is possible for a player to correct a move, by operating an operating means with a correction function. A time limit can be linked to this correction, so that correction is permitted only up until the moment the following player acknowledges his move by operating press-button A, for instance. In addition, returning to the initial situation (reset) whilst playing the current game situation is possible; this can take place per move or in one go. For this purpose the computer game can be provided with one single operating means which contains both above-mentioned reset functions or by two separate operating means, each with one of the reset functions. By returning per move, one can return to a prior game situation from where the game can be resumed.

Although the invention has been described on the basis of the example described above, it will be clear that a computer game according to the present invention can have numerous other embodiments, so that a large number of games can be played. In addition, the games' board can be displayed on a touch-sensitive screen, so that touching a part of the screen which forms the playing area having the same consequences as pressing a press-button.

What is claimed is:

1. A computer game device comprising:

a games' board and a computer connected thereto for controlling game facets, said games' board having a first number of side edges, and a second number of playing areas, each said playing area containing an activation element connected with the computer wherein operating the said activation element activates or deactivates certain said game facets, and having a mark device for separately displaying a number of distinctive marks, said number of distinctive marks corresponding to said first number of side edges, each said mark device being connected to a corresponding said activation element, and to said computer, and being operable by said activation element and/or said computer, each said side edge containing a third number of operating means for operating said computer for activating or deactivating certain said game facets.

2. A computer game device according to claim 1 further comprising a games' board displayed on a touch-sensitive screen and each said activation element is part of the said touch sensitive screen.

3. A computer game device according to claim 1 wherein each said activation element is a push-button.

4. A computer game device according to claim 1 wherein each said mark device has a said distinctive mark comprising a separate color.

5. A computer game device according to claim 4 wherein each said mark device has a fluorescent element for displaying said distinctive mark.

6. A computer game device according to claim 5 wherein each said activation element is a push-button and each said push-button is transparent and the corresponding said fluorescent element is located under said push-button.

7. A computer game device according to claim 1 wherein at least one of said operating means of each said side edge comprises a mark corresponding with one said distinctive mark of the game area.

8. A computer game device according to claim 7 wherein at least one said operating means is a transparent push-button, said distinctive mark is a fluorescent color, and an element fluorescing in said color is located under at least one said operating means.

9. A computer game device according to claim 1 wherein each said side edge comprises a reproduction part for displaying game data.

* * * * *